US008528512B2

(12) United States Patent
Christl

(10) Patent No.: US 8,528,512 B2
(45) Date of Patent: Sep. 10, 2013

(54) CONNECTION ARRANGEMENT FOR CLAMPING A CYLINDER HEAD TO A CRANKCASE OF A RECIPROCATING INTERNAL COMBUSTION ENGINE

(75) Inventor: Helmut Christl, Thierhaupten (DE)

(73) Assignee: MAN Diesel SE, Augsburg (DE)

( * ) Notice: Subject to any disclaimer, the term of this patent is extended or adjusted under 35 U.S.C. 154(b) by 971 days.

(21) Appl. No.: 12/231,254

(22) Filed: Aug. 28, 2008

(65) Prior Publication Data

US 2009/0056666 A1 Mar. 5, 2009

(30) Foreign Application Priority Data

Sep. 5, 2007 (DE) ..... 10 2007 042 156

(51) Int. Cl.
*F02F 3/00* (2006.01)

(52) U.S. Cl.
USPC ..... 123/193.1; 123/193.3; 123/195 R

(58) Field of Classification Search
USPC ..... 123/193.1, 193.5, 193.3, 193.4, 193.2
See application file for complete search history.

(56) References Cited

U.S. PATENT DOCUMENTS

| | | | | |
|---|---|---|---|---|
| 3,069,926 | A * | 12/1962 | Hoffman et al. | 74/580 |
| 3,973,779 | A * | 8/1976 | Burgmann et al. | 277/425 |
| 4,300,776 | A * | 11/1981 | Taubenmann | 277/467 |
| 4,391,238 | A * | 7/1983 | Greier et al. | 123/193.2 |
| 5,056,470 | A * | 10/1991 | Wolters et al. | 123/41.84 |
| 5,095,858 | A * | 3/1992 | Ascari | 123/90.27 |
| 5,095,868 | A * | 3/1992 | Brighigna | 123/193.3 |
| 5,724,863 | A * | 3/1998 | Kramer et al. | 74/583 |
| 6,312,185 | B1 * | 11/2001 | Ernst | 403/288 |
| 2007/0013229 | A1 * | 1/2007 | Plantan et al. | 303/115.1 |

* cited by examiner

*Primary Examiner* — Noah Kamen
*Assistant Examiner* — Long T Tran
(74) *Attorney, Agent, or Firm* — Cozen O'Connor

(57) ABSTRACT

A connection arrangement for clamping a cylinder head to a crankcase by at least one tension rod. A sealing device is associated with the or each tension rod in order to seal an external thread of the tension rod against a medium. To create a new kind of device with tension rod clamping, which omits a slot causing notch stress in the tension rod yet securely protects the thread of the tension rod against corrosive attack the sealing device includes a profiled elastomer sealing ring which is positively fixed within a thread undercut on the circumference of the tension rod shank and which is compressed in a defined manner through the screwing-in of the tension rod in the bore of the assembly and through the surface geometry of the circumference of the tension rod shank and the bore of the assembly.

11 Claims, 2 Drawing Sheets

CONNECTION ARRANGEMENT FOR CLAMPING A CYLINDER HEAD TO A CRANKCASE OF A RECIPROCATING INTERNAL COMBUSTION ENGINE

CROSS REFERENCE TO RELATED APPLICATION

This application claims priority to German Application 10 2007 042 156.9, the contents of which is incorporated herein by reference in its entirety.

BACKGROUND OF THE INVENTION

1. Field of the Invention

The invention relates to a connection arrangement for clamping a cylinder head to a crankcase of a reciprocating internal combustion.

2. Description of the Related Art

In marine diesel internal combustion engines, as well as other internal combustion engines, it is already known as disclosed in DE 10 2005 020 588 A1, to connect assemblies of said engines using several tension rods and to provide a compression preload in the interconnected assemblies via the tension rods. In the case of marine diesel internal combustion engines, a crankcase is preferably connected to a cylinder head via several tension rods.

Tension rods possess an external thread via which the tension rods are connected to one of the assemblies to be interconnected. Specifically, the tension rods are screwed into undercuts of the assembly having an internal thread. In the case of internal combustion engines the thread of each tension rod has to be protected against a corrosive attack by a corrosive medium to guard against a fracture of the tension rod. Sealing devices are associated with the tension rods to prevent the corrosive medium from contact with the tension rod.

Cylinder head tension rods are screwed into the crankcase as deep as possible to subject the casting to compression preload. During engine operation, the cylinder head tension rods are generally surrounded by an oil mist. Through temperature change, water condensation in the crankcase occurs. This water must not come in contact with the thread flanks of the tension rods. As already mentioned, a fracture of the tension rods can result due to corrosion from the water condensation.

Typically, sealing devices associated with the tension rods in internal combustion engines are embodied as O-rings arranged in a slot on each respective tension rod. The condensate is kept away from the thread by means of the O-ring. However, the slot to accommodate the O-ring causes notch stresses in the tension rod, as a result of which the tension rod can fracture during operation.

SUMMARY OF THE INVENTION

Disclosed is a new device using a tension rod that omits a slot in the tension rod yet protects the thread of the tension rod against corrosive attack.

In one embodiment of the invention, the sealing device comprises a profiled elastomer sealing ring which is positively fixed within a thread undercut on the circumference of a tension rod shank and which is pressed into a bore of the assembly in a defined manner by screwing in the tension rod. An O-ring on the tension rod is no longer necessary making the notch or slot on the tension rod according to the prior art to accommodate an O-ring obsolete. Without the slot, the tension rod can accept greater loads or the tension rod can alternatively be embodied with a lesser cross section to achieve the same load capacity.

In another embodiment of the invention, the thread undercut of the tension rod shank has a stress-optimized contour at the upper end seen in screwing-in direction. The profiled elastomer sealing ring is positively fixed so that the profile of the elastomer sealing ring is determined in part by the contour of the thread undercut of the tension rod shank and a conical or cone-shaped spreading thread run-out of an internal thread of the assembly and by a cylindrical bore wall part of the assembly which follows the thread run-out in axial direction. The elastomer sealing ring in the screwed-in state of the tension rod is retained and compressed in a defined manner according to its profile. The stress level on the tension rod shank is reduced. The sealing geometry follows the stress-optimized contour of the thread undercut. Sealing is affected through the compression of the seal at the bore wall in the crankcase, the conical thread run-out of the external thread of the bore in the crankcase, and the contour of the thread undercut on the tension rod.

In one embodiment, the tension rod is tightened with a predetermined torque onto the bearing shoulder of the thread run-out of the external thread in the bore of the assembly which results in a defined compression of the seal.

In one embodiment, the positive fixing of the elastomer sealing ring can be performed by vulcanizing, shrinking, gluing or the like.

An exemplary embodiment of the invention is explained in more detail by means of the drawings without being restricted thereto.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
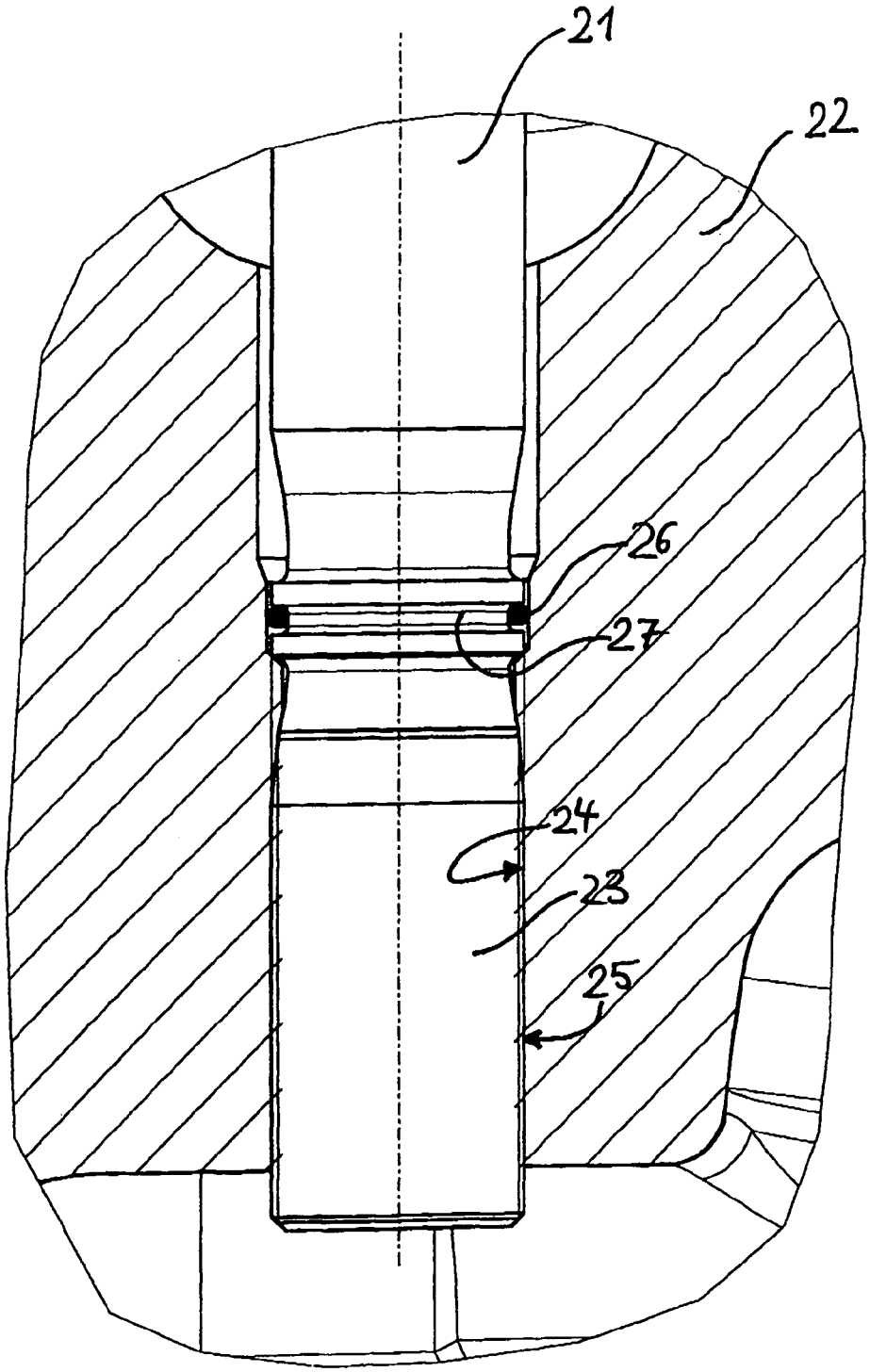
Prior Art Fig. 1
FIG. 1 Depicts a partial cross section of a prior art tension rod clamping assembly.

FIG. 1 shows a partial cross section through a tension rod connection known from the prior art between assemblies of, for example, a marine diesel internal combustion engine in the region of a tension rod 21 and an assembly 22. The assembly 22 in this embodiment, is a crankcase. The tension rod 21 at an end 23 comprises an external thread 24, wherein the tension rod 21 is screwed together with the assembly 22 via the external thread 24, namely with an internal thread 25 of a bore introduced in the assembly 22.

To seal the threads 24, 25 of the tension rod connection between the tension rod 21 and the assembly 22, a sealing device 26 is associated with the tension rod 21, which is embodied as O-ring. The O-ring is arranged in a slot 27 of the tension rod 21. The slot 27 causes notch stresses in the tension rod 21. This reduces the load capacity of the tension rod 21. Furthermore, with the tension rod connection of FIG. 1, the corrosive medium can collect above the sealing device 26 in the area between the tension rod 21 and the assembly 22.

Figure 2:
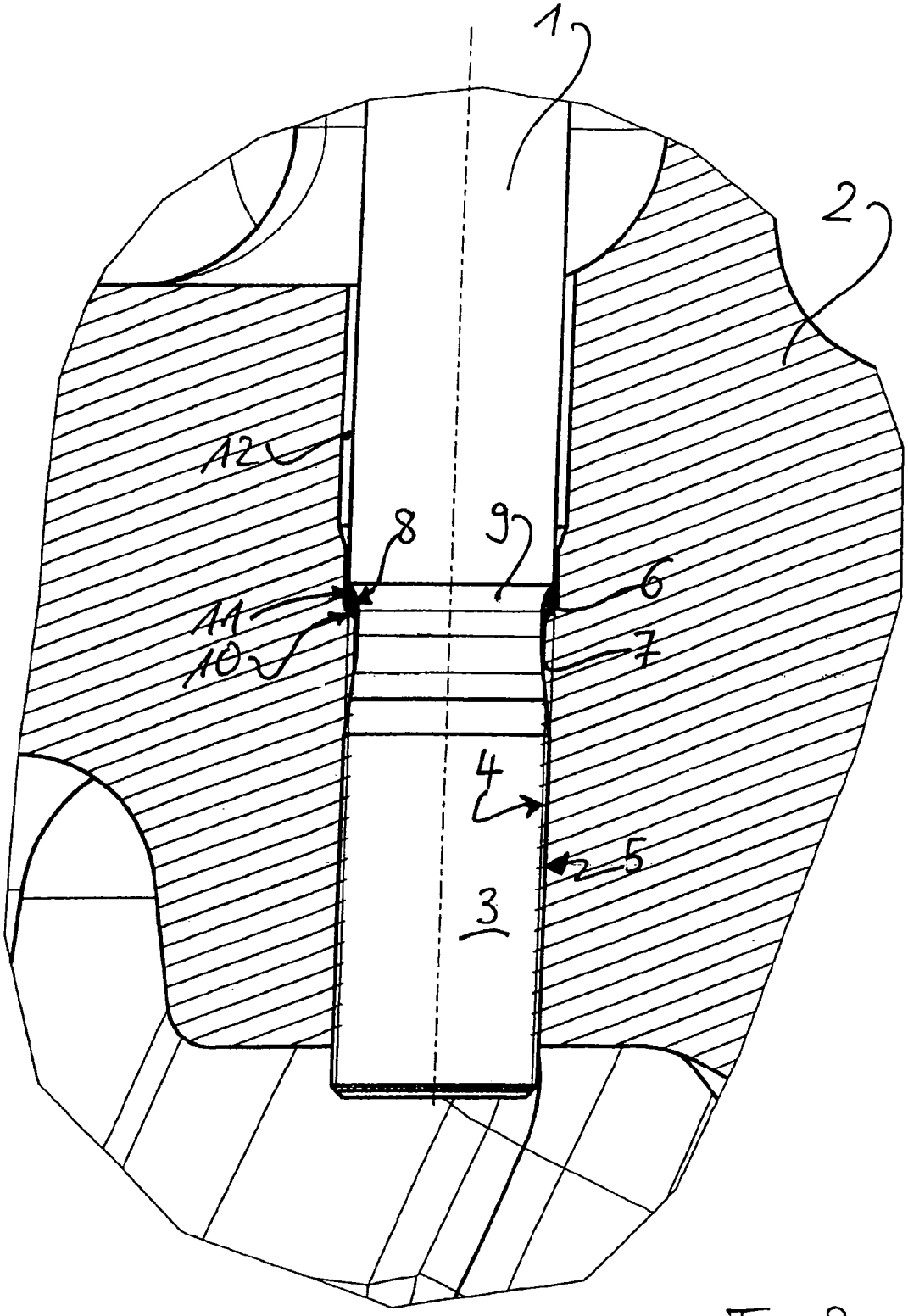
FIG. 2 Depicts a partial cross section of a device with tension rod clamping according to one embodiment of the invention.

FIG. 2 shows a partial cross section through a device according to an embodiment of the invention in the region of the tension rod 1 and an assembly 2. Assembly 2 is preferably a crankcase. The tension rod 1 comprises an external thread 4 on an end 3. As shown, the tension rod 1 is connected with an assembly 2 via the external thread 4. Specifically, tension rod 1 is screwed into a bore 12 of the assembly 2 which has internal thread 5. To seal the thread of the tension rod 1 against attack by a corrosive medium, a sealing device 6 is associated with the tension rod 1. The sealing device 6 comprises a profiled elastomer sealing ring 6 that is positively fixed within a thread undercut 7 on the circumference of the tension rod shank. Profiled elastomer sealing ring 6 is compressed in a defined manner as a result of screwing-in of the tension rod 1 in the bore 12 of the assembly 2.

The thread undercut 7 of the tension rod shank 1 has a stress-optimized contour 8 on the upper end 9 as seen in the screwing-in direction. The profiled elastomer sealing ring 6 is positively fixed to the tension rod 1. The profile of the elastomer sealing ring 6 is determined by the contour of the thread undercut 7 of the tension rod shank 1, a conically shaped thread run-out 10 of an internal thread 5 of the assembly 2, and by a cylindrical bore wall part 11 of the assembly 2 following the thread run-out 10 of the internal thread in axial direction. The elastomer sealing ring 6 in the screwed-in state of the tension rod 1, is compressed in a defined manner in accordance with its profile.

Starting from the thread section 3 of the tension rod shank, the maximum stress curve in axial direction of the tension rod shank is shifted beyond the region of the sealing device. In other words, the arrangement of the elastomer sealing ring is such that corrosive medium collecting above the sealing device cannot harm the tension rod.

The tension rod is tightened against the bearing shoulder of the thread run-out 10 in the assembly 2 using a predetermined torque.

The elastomer sealing ring 6 can be affixed using vulcanizing, shrinking, gluing, and the like. The elastomer sealing ring 6 is adapted to the components which are screwed against one another. The seal is securely chambered through the surfaces bearing against the sealing ring and compressed in a defined manner in-between.

In the tension rod, according to one embodiment of the invention, slots which serve to accommodate O-rings, are omitted. As a result the tension rod can be subjected to greater load. With identical load capacity of the tension rod, its cross section can be reduced. This results in cost and weight advantages.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps that perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A connection arrangement for an assembly of an internal combustion engine, comprising:

at least one tension rod having a first end with an external thread, and the at least one tension rod having a shank with a thread undercut; and a sealing device associated with the at least one tension rod in order to seal the external thread of the tension rod, the sealing device comprising a profiled elastomer sealing ring affixed to the tension rod within the thread undercut on the circumference of the tension rod shank, and the elastomer sealing ring being compressed in a defined manner by the surface geometry of an external circumference of the tension rod shank, and wherein said assembly comprises a bore, said, first end of said tension rod being threadably inserted in said bore of said assembly.

2. The connection arrangement according to claim 1, wherein the thread undercut of the tension rod shank comprises a stress-optimized contour at the upper end defined by an insertion direction the profiled elastomer sealing ring is positively fixed to the at least one tension rod so that the profile of the elastomer sealing ring is determined by the contour of the thread undercut of the tension rod shank, a conical shape of a thread run-out of an internal thread of the assembly as support bearing, and by a cylindrical bore wall part of the assembly which follows the thread run-out in axial direction.

3. The connection arrangement according to claim 2, wherein the tension rod is tightened onto a bearing shoulder of the thread run-out in the assembly with a predetermined torque.

4. The correction arrangement according to claim 1, wherein the positive fixing of the elastomer sealing ring is positively affixed to the at least one tension rod using a connection selected from the group consisting of vulcanization, shrinking, and gluing.

5. The correction arrangement according to claim 1, further comprising a cylinder lid and a crank case, where the cylinder lid and crank case are coupled to the cylinder by the at least one tension rod.

6. A tension rod comprising:

a first threaded portion at a first end of the tension rod;

a thread undercut adjacent to the first threaded portion; and a sealing ring affixed to the tension rod at an end of the thread undercut opposite the first end of the tension rod.

7. The tension rod of claim 6, wherein the thread undercut is concave.

8. The tension rod of claim 7, wherein the seal ring extends beyond the third undercut in a direction away from the first end of the tension rod.

9. The tension rod of claim 7, wherein the seal ring is a profiled elastomer sealing ring affixed to the tension rod within the thread undercut on a circumference of the tension rod.

10. The tension rod of claim 9, wherein the elastomer sealing ring is compressed in a defined manner by a surface geometry of an external circumference of the tension rod shank, and a bore of an assembly when the first end of the tension rod is threadably inserted in the bore of the assembly.

11. The correction arrangement according to claim 10, wherein the elastomer sealing ring is positively affixed to the tension rod using a connection selected from the group consisting of vulcanization, shrinking, and gluing.

* * * * *